US005361716A

United States Patent [19]

Cotton

[11] Patent Number: 5,361,716

[45] Date of Patent: Nov. 8, 1994

[54] BOAT MOORING DEVICE AND METHOD

[75] Inventor: Oren L. Cotton, Eastsound, Wash.

[73] Assignee: Dock Tender, Inc., Eastsound, Wash.

[21] Appl. No.: 138,831

[22] Filed: Oct. 18, 1993

[51] Int. Cl.[5] ..... B63B 21/00

[52] U.S. Cl. ..... 114/230; 114/219

[58] Field of Search ..... 114/230, 219, 251

[56] References Cited

U.S. PATENT DOCUMENTS

| | | | |
|---|---|---|---|
| 973,906 | 10/1910 | Askegren | 114/251 |
| 1,094,610 | 4/1914 | Steinhauer | 114/230 |
| 2,552,424 | 5/1951 | Gorman | 114/230 |
| 2,569,783 | 10/1951 | Smith | 114/230 |
| 2,912,953 | 11/1959 | Olsen | 114/230 |
| 2,938,492 | 5/1960 | Kulick | 114/230 |
| 2,996,033 | 8/1961 | Yordi | 114/230 |
| 3,120,831 | 2/1964 | Fulton | 114/230 |
| 3,157,150 | 11/1964 | Faber, Jr. | 114/230 |
| 3,195,498 | 7/1965 | Johns | 114/230 |
| 4,250,827 | 2/1981 | Booker et al. | 114/230 |
| 4,686,926 | 8/1987 | Vance | 114/230 |
| 5,036,787 | 8/1991 | Rogers | 114/230 |

*Primary Examiner*—Sherman Basinger

*Attorney, Agent, or Firm*—Chernoff, Vilhauer, McClung & Stenzel

[57] ABSTRACT

A method and device for controlling movement of a moored boat employs a boat mooring device comprising a base to be anchored to a pier or float and an upright stem, a helical spring, and a connecting arm having a distal end equipped to be connected to an attachment point on a boat to limit movement of the boat relative to the pier or float. The spring is elastically stretchable to urge the boat toward the pier or float, or bendable into a gooseneck configuration to urge the boat away from the pier or float, in response to the influences of waves or wind. The same spring also automatically retracts the connecting arm into an upright condition when the mooring device is not in use so that it does not present an obstacle to docking the boat.

8 Claims, 5 Drawing Sheets 56
54
58
52
46
50
40
44
48
42
36
38
37
32
78
79
34
35
28
30
27
18
22
20
10
26
24
13
12
14
16
49

BOAT MOORING DEVICE AND METHOD

BACKGROUND OF THE INVENTION

The present invention relates to mooring floating vessels such as pleasure boats, and particularly relates to mooring boats alongside piers or moorage floats.

When a boat is moored alongside a pier or float by use of lines, fenders are traditionally placed between a side of the boat and the face of the pier or float to prevent damage to the side of the boat. A fender can prevent serious structural damage, but where currents and storm waves cause significant, prolonged movement of a boat relative to the pier or float, fenders rubbing on the boat's hull can eventually cause considerable damage to the paint or other surface finish. Fenders, moreover, are subject to being pulled or rolled out of their proper locations where there is a great deal of movement of a boat relative to the pier or other moorage structure, as when tides, storm waves, or currents urge the boat toward the pier or float or cause large vertical movements of the boat relative to the pier face.

In order to prevent excessive motion of a boat alongside a pier it has been necessary in the past to adjust conventional mooring lines in response to tidal rise and fall of the water with respect to the pier. While such adjustment of mooring lines to accommodate tides is not a problem for a boat moored to a float free to rise and fall on the tide, it is sometimes difficult to limit movement of a boat alongside a float to the extent desired without undesirably straining mooring lines when the boat moves relative to the float in response to storm waves or wakes of passing vessels.

One attempt to solve these old problems is disclosed in Booker et al. U.S. Pat. No. 4,250,827, which teaches use of opposing helical compression springs to control relative linear movements of telescopically sliding parts of an arm, to hold a boat, connected to the outer end of the arm, at a desired distance from a pier. When the device is not in use, an elbow spring raises the arm to a tilted, upwardly-extending position. The elbow spring also accommodates vertical motion of the boat relative to the pier. Although the combination of the opposing compression springs and elbow spring provides the necessary elastic resistance to the motion of the boat, it has several significant disadvantages. The sliding telescopic action of the compression springs and arm can be extremely noisy, creating a constant annoyance, particularly after the moving parts have been exposed to the weather for some time. Also, the structure requires three springs and a complex telescopic arm, which makes it expensive. If the sliding telescopic action of the compression springs is eliminated, the elbow spring alone is too short to provide a sufficient range of resilient resistance to movement of the boat toward and away from the dock, which overstresses the portion of the boat to which the arm is attached. Another disadvantage of this device is that it will perform differently depending upon the freeboard height of the particular boat moored to it, because variations in such height significantly change the angular attitude of the arm relative to the elbow spring, whose height cannot easily be adjusted. Finally, the elbow spring raises the arm to a tiled, rather than vertical, position when not in use. Such tiled position can present an obstacle to the docking of a boat of sufficient freeboard height.

Yordi U.S. Pat. No. 2,996,033 discloses a device which includes a cable located within an elbow spring connecting an arm to a base. This cable limits elastic extension of the spring which, similarly to the problem discussed above, provides an insufficient range of resilient resistance to movement of the boat toward or away from the dock, thereby overstressing the point of attachment of the arm to the boat. Also, no easy adjustability of the spring height is provided to avoid significant changes in arm attitude for boats having different freeboard heights.

Kulick U.S. Pat. No. 2,938,492 teaches use of a helical coil spring extending upward from a base mounted on a boat. The top end of the spring is linked together with an arm of adjustable length which has an opposite end detachably fastened to the structure of a pier. The boat can move horizontally a limited distance as the arm causes the upper end of the generally vertically-extending spring to bend resiliently. However the spring, not being prestressed by the weight of the boat and allowing large horizontal deflections at its top without significant stress, would offer insufficient resistance to boat movement toward or away from the dock to be able to contain such movement within an acceptably small range. The Kulick device, moreover, requires a special fitting mounted on the boat to hold the spring, and thus presents the spring as an obstruction on deck on the boat. While the spring can be removed from the fitting, its removal and replacement detract from convenience of use of the device. Also, the spring provides no elbow function for automatically raising the arm when not in use, creating a further inconvenience.

Olsen U.S. Pat. No. 2,912,953 discloses use of a horizontally-oriented helical spring with a ring mounted at its distal end to fasten a small boat to an anchor post rather than a pier or float. Such a device, however, offers little range of resilient resistance to movement, is likely to be very noisy as the ring slides up and down along the anchor post, and is clearly not well adapted for use with anything but very small boats.

Steinhauer U.S. Pat. No. 1,094,610 discloses a device which rigidly holds a small boat with respect to longitudinal motion parallel to the face of a pier, while including a push-pull dual compression spring mechanism similar to that used in the Booker device to control lateral movement of the boat. The device thus has drawbacks similar to those of the Booker et al. device mentioned above.

Gorman U.S. Pat. No. 2,552,424 discloses an arrangement of helical springs intended to control movement of a small boat by application of spring tension to move the boat in a required direction to maintain its position. The arrangement, however, requires a boat to be placed within a slip where the devices can be attached to the boat from each side, and from the front.

Smith U.S. Pat. No. 2,569,783 discloses a device including an arm of a fixed length interconnecting a ball joint located on a boat with an attachment point located on a pier. While vertical motion and a limited amount of fore-and-aft movement of the boat are permitted by the arrangement, the fixed length of the connecting arm severely limits the freedom of the boat to move laterally, causing unnecessarily large forces to be concentrated on the boat at the point of attachment of the arm to the boat.

Fulton U.S. Pat. No. 3,120,831 discloses a long resiliently flexible mooring whip, to be bent and attached to a boat moored by conventional mooring lines, to pull the boat away from a pier or float by the elastic forces of the whip. The device is very long and somewhat unsightly in construction, however, and rather than establishing a neutral mooring position for a boat, the device always tends to keep tension in at least some of the mooring lines.

Faber, Jr. U.S. Pat. No. 3,157,150 discloses a device including a connecting arm pivotally spring-mounted on a base and including a suspended spring carried at the distal end of the connecting arm to connect the arm to a small boat. The multi-spring arrangement would be expensive, and the suspended distal spring would provide little resistance to boat movement toward or away from the dock within an acceptably small range.

What is needed, then, is a mooring device of simple, inexpensive construction, capable of very quiet operation and useful for boats of large and small sizes alike, either in combination with or independent of conventional mooring lines, to control movement of a boat with respect to a dock with sufficient resilient resistance without imposing undue stress on either the boat or the dock and thereby reduce dependence on conventional fenders. Preferably the device should be easily adjustable to operate similarly for boats of different freeboard heights.

SUMMARY OF THE INVENTION

The present invention satisfies the foregoing needs by providing a method and device for limiting the movement of a moored boat by utilizing an elongate spring resiliently stretchable longitudinally and bendable along its length, and capable of exerting a high degree of elastic restorative force on a moored boat as necessary to prevent it from moving too close to or too far away from a moorage structure.

A mooring device according to the present invention includes a base adapted to be fastened to a moorage structure. A stem extends up from the base, and the aforementioned spring is rigidly attached to the stem, extending upwardly. A rigid connecting arm has a proximal end attached rigidly to an upper end of the spring and has a distal end equipped to be linked detachably to an attachment fixture on the boat. Lowering the distal end of the connecting arm by moving it to a generally horizontal orientation to link it to the attachment fixture on the boat bends the spring into a first arcuate configuration. With the distal end of the connecting arm linked to the attachment fixture, movement of the boat away from the pier pulls the connecting arm and tends to stretch the spring longitudinally, creating tension forces to return the boat toward the pier. On the other hand, movement of the boat too close to the pier forces the spring to bend elastically into a gooseneck configuration, creating elastic restorative forces in the spring to urge the connecting arm, and thus the boat, away from the pier.

When the distal end of the connecting arm is detached from the attachment fixture on the boat, the same spring retracts the arm upwardly from its generally horizontal operative orientation and thereby keeps the arm generally upright so that it does not present an obstacle to docking the boat.

Preferably, the height of the spring is easily adjustable relative to the base of the mooring device to accommodate boats of different freeboard heights without affecting the operation of the device.

It is an important feature of the mooring device of the present invention that the spring is free to stretch longitudinally and to bend elastically between the base and the connecting arm of the mooring device, within a large range of elastic deformation, so that the spring will extend either arcuately or in a gooseneck configuration to resiliently urge the boat respectively toward or away from the moorage structure on which the mooring device is mounted.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figures 1, 2, 3:
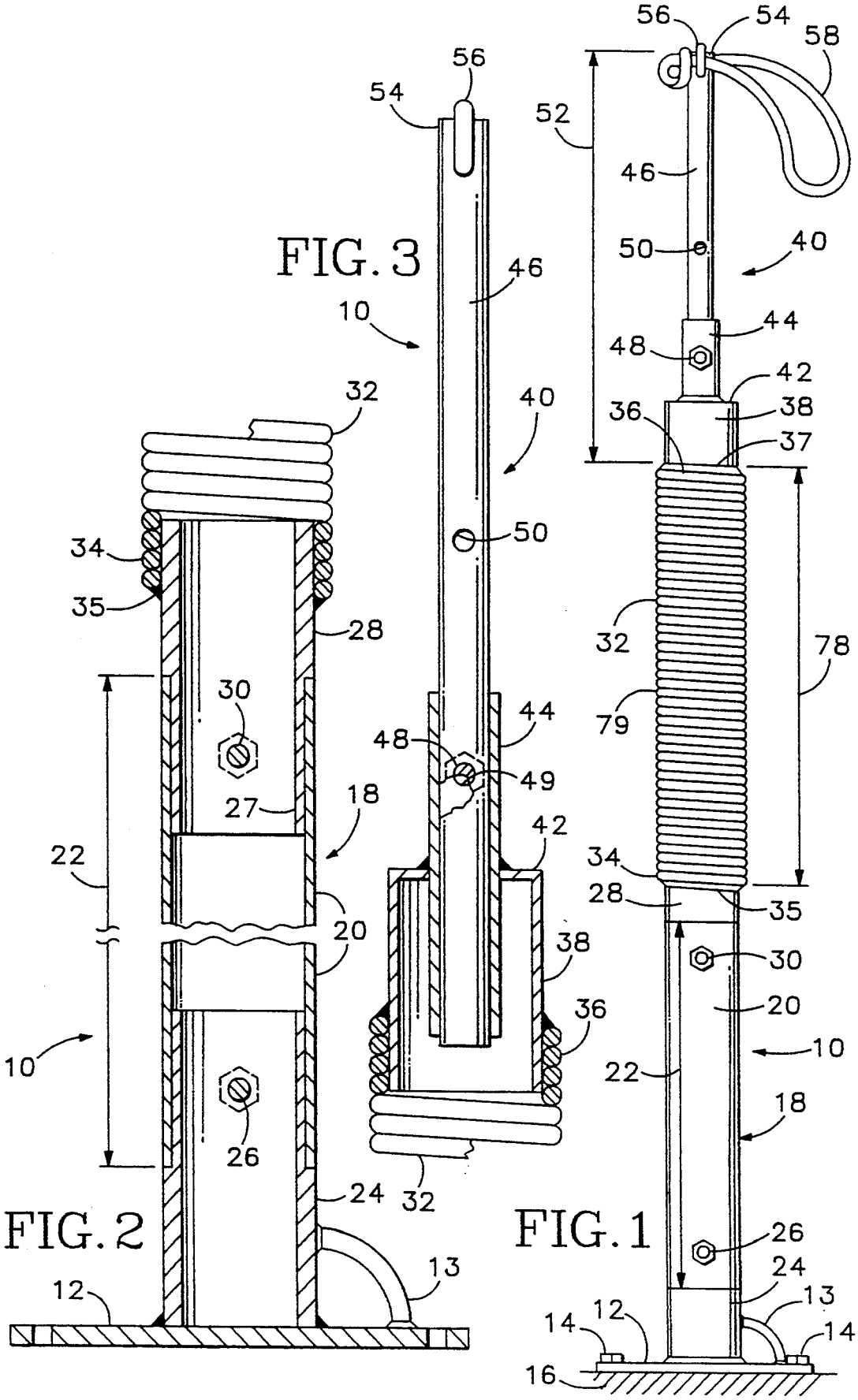
FIG. 1 is an elevational view of a boat mooring device according to the present invention, in its retracted, upright, out-of-use configuration.
FIG. 2 is an enlarged sectional view showing the structure of the lower portion of the mooring device shown in FIG. 1.
FIG. 3 is an enlarged sectional view showing the upper end of the spring, together with the connecting arm of the mooring device shown in FIG. 1.

Referring now to the drawings which form a part of the disclosure of the invention, a mooring device 10 is shown in FIG. 1 in an upright, substantially vertical position in which the mooring device 10 is not in use but is ready for eventual use in mooring a boat. The mooring device 10 has a base 12 securely attached, as by bolts 14, to a portion of a moorage structure such as a pier 16. A line-securing ring 13 is attached to the base 12.

A stem 18 extends upwardly from the base 12 and preferably includes a tubular body portion 20 whose length 22 is chosen variably to be appropriate for the location where the mooring device 10 is to be used and the freeboard height of the boat to be moored. A lower end of the tubular body portion 20 fits as a sleeve around the upper end of a short stem attachment portion 24 of the base 12, and is fastened detachably thereto by a through-bolt 26. The opposite, or upper, end of the tubular body 20 of the stem 18 receives and fits as a sleeve around a reduced-diameter portion 27 at the lower end of a spring-mounting tube 28 which is the upper end of the stem 18. The upper end of the tubular body 20 is detachably fastened to the reduced-diameter portion 27 by a through-bolt 30. The variable lengths of the tubular body 20 which can thus be inserted detachably between the base 12 and the spring-mounting tube 28 provide vertical adjustability of the spring-mounting tube 28 relative to the base 12. Alternatively, additional bolt holes could be provided in a lengthened portion 27 to adjust the height of the tube 28 relative to the base 12.

A helical spring 32 has a base end portion 34 which fits closely and rigidly around the spring-mounting tube 28, as shown in FIG. 2. The helical spring 32 is closely wound, and a plurality of its coils, for example about four coils of the base end 34 of the spring 32, are wrapped tightly about the spring-mounting tube 28. The bottom coil is welded to the spring-mounting tube 28 as shown at 35.

As shown in FIG. 3, the opposite, or upper, end 36 of the helical spring 32 is attached to the proximal end 38 of a rigid connecting arm 40. The proximal end 38 of the connecting arm 40 is tubular, fitting rigidly within a number of coils of the helical spring 32 in much the same way as the spring-mounting tube 28 fits within the base end 34 of the helical spring 32. The end coil of the upper end 36 is securely welded, as shown at 37, to the proximal end 38 of the connecting arm 40 so that the connecting arm 40 extends coaxially from the upper end 36 of the spring 32.

The tubular proximal end portion 38 includes an annular end face 42 in which a tube 44 of significantly smaller diameter is mounted, extending coaxially with the upper end 36 of the spring 32. A rigid arm extension portion 46 fits snugly within the tube 44 and is held at a position established by a fastener such as a bolt 48 extending through diametrically opposed fastening holes 49 in the tube 44 and the appropriate hole 50 extending diametrically through the arm extension 46, so that the connecting arm 40 can be adjusted to a desired effective overall length 52 (FIG. 1).

At the distal end 54 of the connecting arm 40, a pair of rings 56 are welded to the arm extension 46 to receive a fastening device, such as a loop 58 of rope suitable to fasten the distal end 54 closely to an attachment fixture such as a cleat 60 on a boat, as by placing the loop 58 through the base and around the horns of the cleat 60 as shown in FIGS. 4 and 6–10. Alternatively, a shackle may be placed through a ring 56 to fasten the distal end 54 securely and closely to a padeye mounted on a boat.

The entire mooring device 10, including the spring 32 and the bolts 14 and 48, is preferably made of stainless steel in order to avoid corrosion caused by the environment in which the mooring device 10 is customarily used. However all or portions of the device could be made of other strong, durable, corrosion-resistant materials such as plastic. In particular, the spring 32 could be of a configuration other than helical, so long as it possesses both longitudinal stretchability and bendability.

Figure 4:
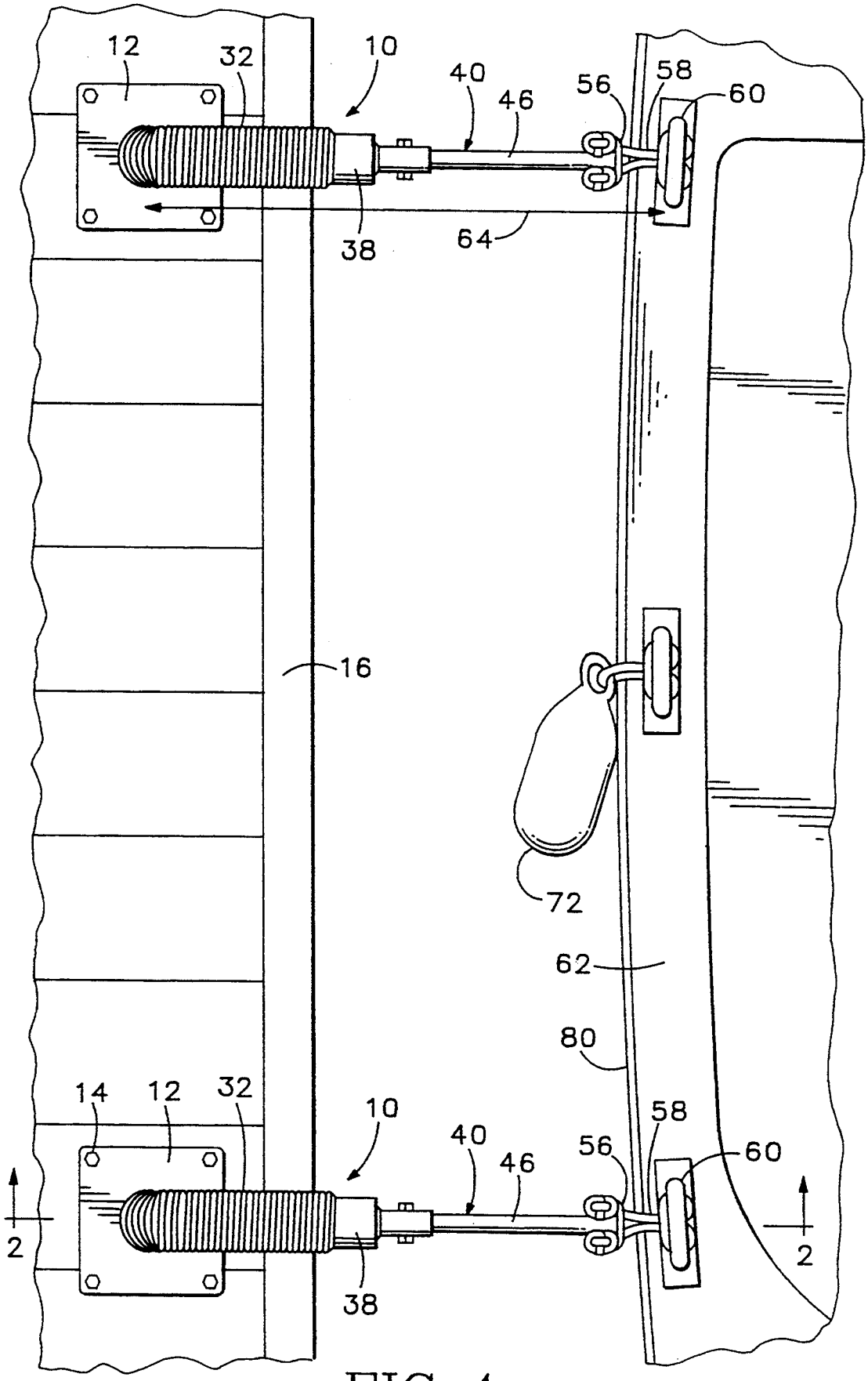
FIG. 4 is a top plan view of a portion of a pier and a portion of a boat moored alongside the pier by the use of two mooring devices of the type shown in FIG. 1.
Figure 6:
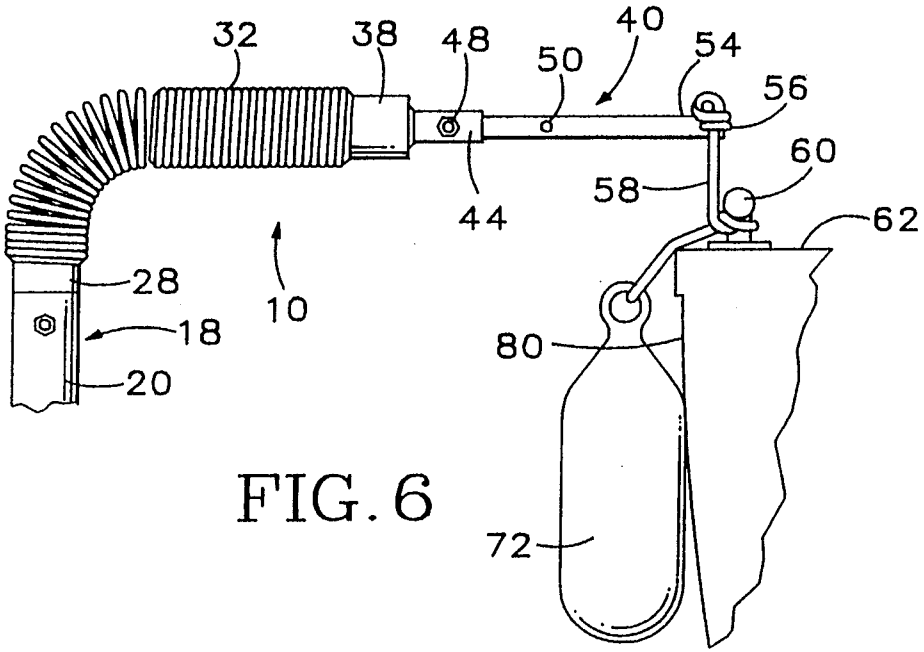
FIG. 6 is an elevational view of a portion of the boat shown in FIG. 4 and one mooring device of the type shown in FIGS. 1–4, taken in the direction indicated by the line 2—2 in FIG. 4, and showing a generally horizontal position of the spring with the boat moored with normal water level and calm conditions.

Referring to FIG. 4, a pair of mooring devices 10 can be mounted on the pier 16, spaced apart from each other with each attached to a respective cleat 60 located on the deck of a boat 62. With the stem 18 including the tubular body 20 giving the appropriate length 22 (FIG. 2), the loop 58 fastens the rings 56 to the cleat 60 at each location. This preferably holds the connecting arm 40 in a generally horizontal orientation, as shown in FIG. 6, when the boat 62 is floating in calm water alongside the pier 16. The term "generally horizontal" as used herein is intended to include inclined positions of the arm 40 as well as the true horizontal position shown in FIG. 6, such positions varying according to different conditions and applications. The boat 62 is thus held with each cleat 60 spaced apart from the respective base 12 by a distance 64 (FIG. 4) established by the length 52 of the connecting arm 40 together with a portion of the length of the spring 32, and the spring 32 is bent elastically into a first arcuate configuration as shown in FIG. 6.

Elastic restorative forces are generated within the spring 32 by bending it elastically to bring the connecting arm 42 to the generally horizontal position shown in FIG. 6 to permit the loop 58 to extend from the rings 56 to the cleat 60. Such elastic forces will restore the mooring device 10 to the upright out-of-use position shown in FIG. 1 when it is not in use. When in use, on the other hand, such elastic forces keep the loop 58 under some tension, and prevent the rings 56 from contacting the cleat 60 under most conditions.

Figure 5:
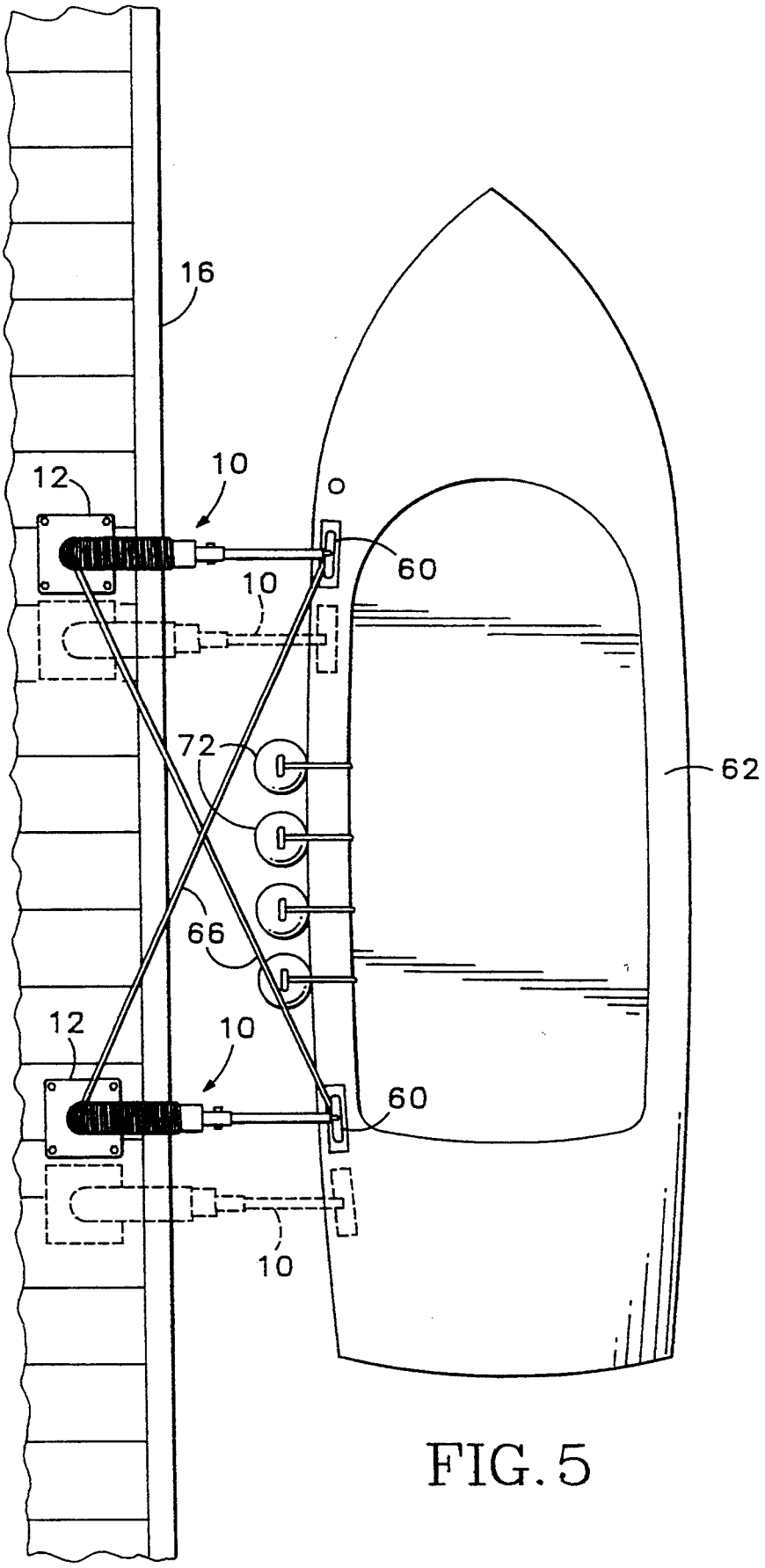
FIG. 5 is a top plan view showing the use of mooring lines together with the mooring devices shown in FIGS. 1–4 to moor a boat to a pier.

As shown in FIG. 5, conventional crossed mooring lines 66, referred to as spring lines, are preferably provided to limit fore-and-aft movement of the boat 62 while permitting, due to their substantial length, maximum vertical boat movement without straining the lines or the cleats to which they are attached. The lines 66 are secured to the respective bases 12 by means of the rings 13. The lines 66 preferably limit fore-and-aft movement of the boat 62 so that the connecting arm 40 of each mooring device extends at a right angle outward from the pier 16 as viewed in a horizontal plane, as shown in FIG. 5. For a larger boat, a pair of mooring devices 10 can be located close together side-by-side, as indicated in broken line view in FIG. 5, instead of using only a single mooring device 10 near each end of the boat 62, to provide enhanced control of the lateral movement of the boat 62 without resorting to springs 32 of unmanageable size and strength. Fenders 72 are still useful to protect the side of the boat 62 from contacting the face of the pier 16 directly, but the action of the mooring devices 10 reduces the amount of pressure which must be carried by the fenders 72, as compared with mooring without the mooring devices 10, thus reducing the likelihood of damage to the boat's finish by the fenders 72.

Figure 7:
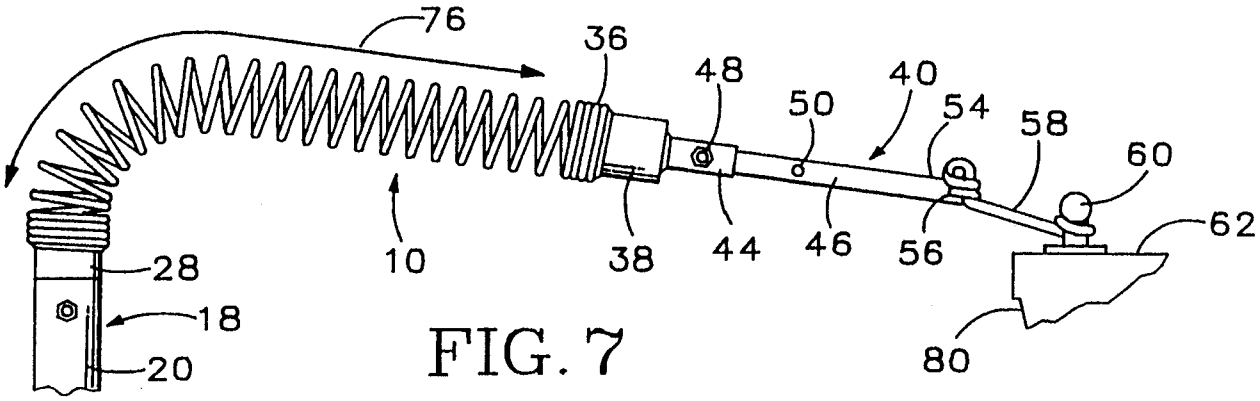
FIG. 7 is an elevational view, similar to that of FIG. 6, showing the arcuately extended configuration of the mooring device in response to movement of the boat away from the pier, as might result from wind and wave action.

As shown in FIG. 7, in response to lateral motion of the boat 62 away from the pier 16 caused by waves, wind or currents, the spring 32 is elastically stretched longitudinally, as indicated by the arrow 76, beyond its unextended length 78 shown in FIG. 1 and beyond its arcuate configuration shown in FIG. 6. Such elastic extension of the spring 32, as indicated by the arrows 74 and 76, is caused by tension exerted against the spring 32 through the connecting arm 40 and results in opposing restorative elastic tension forces being developed in the spring 32 which attempt to return the spring 32 to the configuration of FIG. 6. Such forces, acting through the connecting arm 40 and the loop 58, tend to pull the boat 62 back toward the position shown in FIG. 6.

Figure 8:
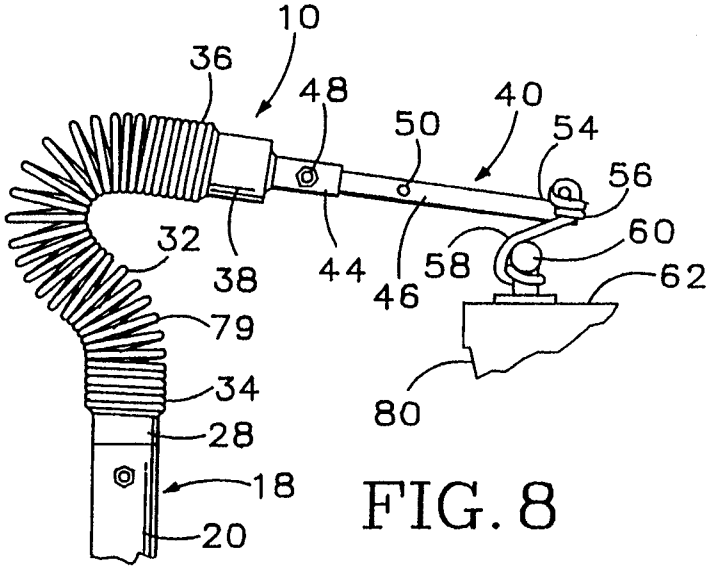
FIG. 8 is an elevational view, similar to that of FIG. 6, showing the gooseneck configuration of the mooring device in response to movement of the boat toward the pier.

On the other hand, when the forces of wind, waves or currents push the boat 62 toward the pier 16, the cleat 60 pulls the loop of line 58 toward the configuration shown in FIG. 8, pulling the distal end 54 of the connecting arm 40 toward the pier 16. With the boat 62 limited in its freedom to move fore-and-aft alongside the pier 16 by lines 66, or by the springs 32 in the absence of such lines as shown in FIG. 4, motion of the boat 62 toward the pier 16 causes compressive forces to be transferred longitudinally of the connecting arm 40, urging its proximal end 38, together with the upper end 36 of the spring 32, toward the stem 18 of the mooring device 10. This causes an intermediate portion 79 of the spring 32, above the base end 34, to be bent elastically away from the boat 62, while a further, somewhat higher intermediate portion of the spring 32 is curved elastically in the opposite direction, that is, concave toward the boat 62. The spring 32 thus elastically assumes a gooseneck curvature, as shown in FIG. 8, as a result of the compressive forces carried longitudinally through the connecting arm 40 toward the stem 18. This elastic displacement of the spring 32 from the arcuate position shown in FIG. 6 establishes considerable elastic restorative forces in the spring 32, directed through the connecting arm 40 and loop 58, to repel the boat 62 away from the pier 16 toward the position shown in FIG. 6. These repulsive forces acting on the cleats 60 reduce by a substantially equal amount the forces which tend to compress the fenders 72 between the pier 16 and the side 80 of the hull of the boat 62. As a result, the amount of pressure against the fenders 72, and resulting abrasion of the finish of the side 80 of the boat 62 are significantly reduced by use of the mooring devices 10 of the invention to resist and limit movement of the boat 62 relative to the pier 16.

In order to achieve an adequate range of elastic tension and repulsion forces to avoid undue stress on the boat attachment fixture 60 and pier 16, the spring 32 should have an unstretched length 78 which is approximately as great as the overall length 52 of the connecting arm 40 as shown in FIG. 1, or somewhat greater than the arm length 52.

Figure 9:
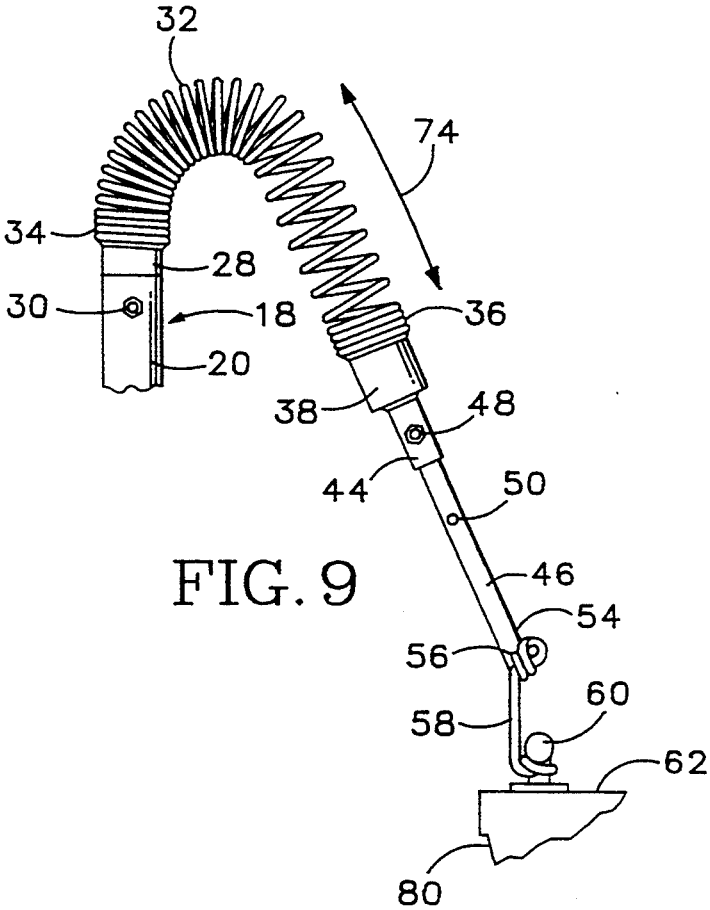
FIG. 9 is an elevational view, similar to that of FIG. 6, showing the configuration of the mooring device as a result of the moored boat being in a lowered position, as in response to low tide conditions or descending into the trough of a wave passing the pier.
Figure 10:
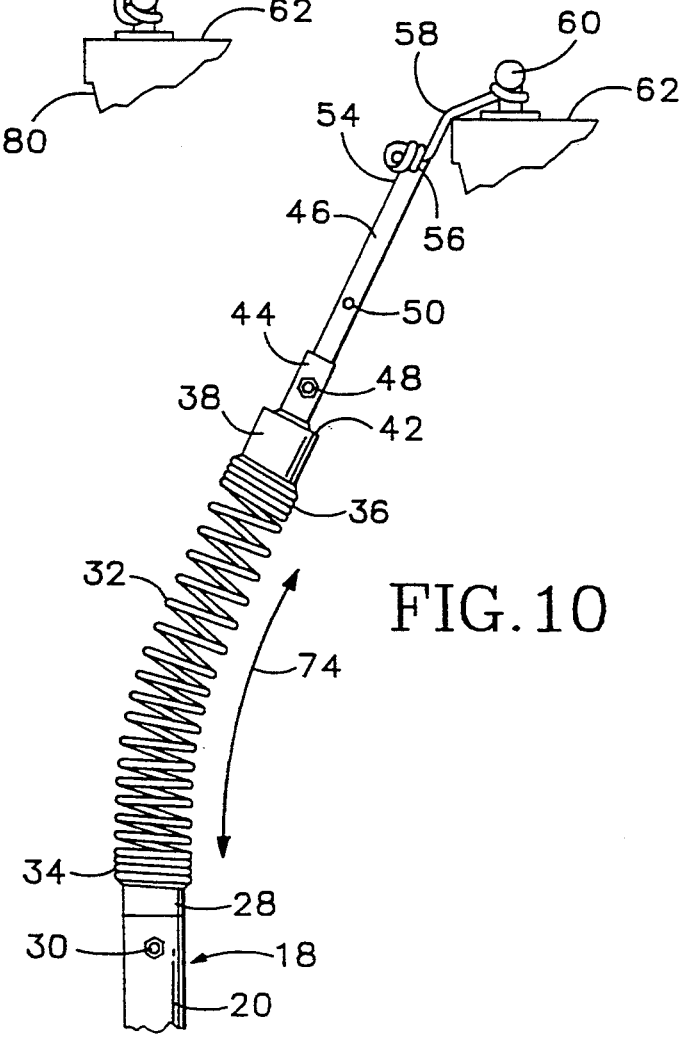
FIG. 10 is an elevational view, similar to that of FIG. 6, showing the configuration of the mooring device with the boat in an elevated position with respect to the pier, such as might be caused by riding the crest of a wave or by high tide conditions.

In order to accommodate changes in the height of the water alongside the pier 16, as may be caused by tides or storm waves, flexure of the spring 32 also accommodates significant vertical motion of the boat 62. For example, the connecting arm 40 can be moved to a more depressed orientation, as shown in FIG. 9, to accommodate a lower position of the boat 62, or to a more elevated orientation to accommodate a higher position of the boat 62, as shown in FIG. 10. In either condition, the spring 32 may be elastically extended longitudinally to some extent, as indicated by the arrows 74, thus creating additional elastic restorative forces tending to move the boat 62 back to the preferred position.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for limiting movement of a moored boat having an attachment fixture, said method comprising:

(a) providing a mooring device including an elongate spring resiliently stretchable longitudinally and bendable along its length, said spring having a base end and an upper end;

(b) mounting said spring at a predetermined location on a moorage structure so that said base end is rigidly oriented generally upright relative to said moorage structure;

(c) attaching a proximal end of a substantially rigid, elongate connecting arm rigidly at said upper end of said spring;

(d) elastically bending said spring to a first arcuate configuration by moving said connecting arm to a generally horizontal orientation;

(e) linking a distal end of said connecting arm to said attachment fixture on said boat;

(f) opposing movement of said attachment fixture toward said predetermined location by bending said spring elastically into a gooseneck configuration generating elastic repulsive forces to restore said spring to said first arcuate configuration, and directing said repulsive forces along said connecting arm toward said attachment fixture to push said attachment fixture away from said predetermined location, thereby resisting movement of said boat toward said moorage structure;

(g) opposing movement of said attachment fixture away from said predetermined location by generating elastic tension forces in said spring by longitudinal stretching thereof and transmitting said elastic tension forces through said connecting arm to pull said attachment fixture toward said predetermined location, thereby resisting movement of said boat away from said moorage structure; and (h) causing the unstretched length of said spring, between said base end and said upper end, to be at least as great as the length of said connecting arm between said proximal end and said distal end.

2. A mooring device for connecting a boat having an attachment fixture to a moorage structure, said mooring device comprising:

(a) a base adapted to be fastened to a moorage structure;

(b) an elongate spring resiliently stretchable longitudinally and bendable along its length, said spring having a base end and an opposite upper end, said base end being attached substantially rigidly to said base in an upstanding orientation;

(c) a substantially rigid, elongate connecting arm having a proximal end attached substantially rigidly at and extending parallel with said upper end of said spring and having an opposite distal end;

(d) a linkage associated with said distal end of said connecting arm for fastening said distal end removably to said attachment fixture on said boat;

(e) said spring comprising means for elastically holding said connecting arm in a generally upstanding orientation when said distal end is free from said attachment fixture on said boat, and for elastically bending into a first arcuate configuration when said connecting arm is moved to a generally horizontal orientation;

(f) said spring further comprising means for stretching elastically and thereby applying an elastic tension force to said connecting arm as a result of movement of said connecting arm away from said base when said arm is in said generally horizontal orientation, and for assuming elastically a gooseneck bend configuration and thereby applying an elastic repulsive force toward said connecting arm as a result of movement of said connecting arm toward said base when said arm is in said generally horizontal orientation;

(g) said spring having an unstretched length, between said base end and said upper end, which is at least as great as the length of said connecting arm between said proximal end and said distal end.

3. The method of claim 1 wherein step (h) comprises causing said unstretched length of said spring to be greater than said length of said connecting arm.

4. The method of claim 1, further including the step of adjustably shortening said length of said connecting arm.

5. The method of claim 1 wherein step (b) comprises attaching said base end of said spring rigidly to a base and fastening said base to said moorage structure to form an interconnection therebetween, further including adjusting the height of said base end of said spring relative to said base without affecting said interconnection.

6. The apparatus of claim 2 wherein said unstretched length of said spring is greater than said length of said connecting arm.

7. The apparatus of claim 2, further including means for adjustably shortening said length of said connecting arm.

8. The apparatus of claim 2, further including adjustment means for enabling the selective adjustment of the height of said base end of said spring relative to said base without affecting the interconnection of said base with said moorage structure.

* * * * *